US006171121B1

(12) United States Patent
Krappel et al.

(10) Patent No.: US 6,171,121 B1
(45) Date of Patent: Jan. 9, 2001

(54) BATTERY CABLE CLAMP FOR A VEHICLE AND METHOD OF MANUFACTURING THEREFOR

(75) Inventors: Alfred Krappel, Ismaning; Robert Albiez, Reichertshofen; Maximilian Groebmair, Dietramszell; Guenther Noelle, Loerrach, all of (DE)

(73) Assignees: Bayerische Motoren Werke Aktiengesellschaft, Munich; Auto-Kabel Hausen GmbH and Co. Betriebs-KG, Hausen, both of (DE)

( * ) Notice: Under 35 U.S.C. 154(b), the term of this patent shall be extended for 0 days.

(21) Appl. No.: 09/125,603

(22) PCT Filed: Feb. 20, 1997

(86) PCT No.: PCT/EP97/00813

§ 371 Date: Dec. 23, 1998

§ 102(e) Date: Dec. 23, 1998

(87) PCT Pub. No.: WO97/31406

PCT Pub. Date: Aug. 28, 1997

(30) Foreign Application Priority Data

Feb. 21, 1996 (DE) ..... 196 06 448

(51) Int. Cl.[7] ..... H01R 13/62
(52) U.S. Cl. ..... 439/158
(58) Field of Search ..... 439/158, 764; 180/279, 283; 200/61.08; 307/10.1

(56) References Cited

U.S. PATENT DOCUMENTS 3,120,591 * 2/1964 Lewis ..... 200/82
3,372,476 * 3/1968 Peiffer et al. .
4,505,196 * 3/1985 Fulton .
5,725,399 * 3/1998 Albiez et al. ..... 439/158

FOREIGN PATENT DOCUMENTS

665566 * 8/1995 (EP) .
923568 * 4/1963 (GB) .

* cited by examiner

*Primary Examiner*—Neil Abrams
(74) *Attorney, Agent, or Firm*—Evenson, McKeown, Edwards & Lenahan, P.L.L.C.

(57) ABSTRACT

In a battery cable clamp for vehicles with a mounting device for a cable end, in which two clamp parts (2,4) are connected together in an electrically conducting fashion by a pressed connection that can be broken with a high separating force by an auxiliary drive, the pressed connection is composed of a conical contact surface. An explosive capsule (3) may be used to provide the separating forces. A plastic sleeve (18,18') may be used to control travel of the expelled clamp part and to prevent accidental reengagement. The explosive capsule may be part of the battery clamp (8) or part of the battery lead (5).

5 Claims, 9 Drawing Sheets

BATTERY CABLE CLAMP FOR A VEHICLE AND METHOD OF MANUFACTURING THEREFOR

BACKGROUND AND SUMMARY OF THE INVENTION

The invention relates to a battery cable clamp for vehicles, with a mounting device for a cable end piece in which two clamp parts are held together in electrically conducting contact via a pressed connection that can be released by an auxiliary drive with a high separating force, as well as a method for manufacturing such a cable clamp.

A cable clamp of this kind and a method for its manufacture are known from WO 95/21454 A the U.S. equivalent of which is U.S. Pat. No. 5,725,399. The two clamp parts have a cylindrical surface. This produces various disadvantages. First, the contact force depends on the manufacturing tolerances of the two clamp parts and cannot be exactly defined. From this there arises the disadvantage that the auxiliary drive must be dimensioned so that sufficient efficacy is obtained under extreme conditions. Since the auxiliary drive as a rule is provided by an explosive capsule, the result is a relatively high brisance of the explosive capsule. As a result, a reliable prevention of an inadvertent triggering of the explosive capsule which would endanger the health of a person (for example, during a repair in the engine compartment) is required. There is also considerable expense associated with a protective sheath, for example, as well as a relatively large additional weight associated therewith for the entire cable clamp.

The efficacy of a cable clamp with cylindrical contact surfaces on the clamp parts poses problems, since the two clamp parts do not separate until a considerable distance has been traveled. If an explosive charge is used as an auxiliary drive as explained above, its effect is determined by the amount of gas that is produced when the explosive capsule is triggered. A gas volume that is proportional to the distance is used to separate the two clamp parts from one another. Since the gas volume must both exert the breakaway forces for the clamp connection and produce the relative movement of the two clamp parts away from one another, a considerable amount of explosive is needed. This presents the considerable disadvantages previously described.

The object of the present invention is to provide a battery cable clamp of in which the two clamp parts are separated from one another in a definite fashion, with a minimum expulsion force of the auxiliary drive and to provide a method by which these effects can be achieved at a low manufacturing cost.

This and other objects and advantages are achieved by the battery cable clamp according to the present invention, in which the use of a cone (conical seat), because of the self-locking effect of a cone, results in a specific retaining force of the two clamp parts and results in contact separation with a minimum relative movement between the two clamp parts. This is true provided that contact with the wall is avoided. A conical seat in turn is easy to manufacture, since any manufacturing tolerances due to the surface structure are largely compensated. In addition, the clamping force can be simply monitored throughout the entire assembly process, and thus the breakaway force can be set in a specific ratio to the maximum clamping force.

As a rule, the breakaway force is generated with the aid of an explosive. The quantity of explosive can be relatively small since it is merely necessary to overcome the breakaway force. Because of the resultant relative movement, the contact separation is guaranteed to be rapid and safe.

Optimum control of the contact force and breakaway force can be achieved by a number of different measures. Thus the two cone angles can be made nearly identical. In contrast to a relative difference between the two cone angles, this produces a contact surface on the two clamp parts over their entire surfaces that are in contact with each other. The contact surfaces can be additionally surface-treated, plated by tinning and/or glued together, for example. The adhesive can be made so that it becomes effective only during the fitting process. The adhesive force can also depend on the squeezing pressure. This produces a clamping connection of the two clamp parts that is stable in the long term and remains practically constant over the entire lifetime in terms of expulsion force.

In order to avoid reactions between the auxiliary drive and the battery terminal, the recoil force at the battery terminal can be deflected. This deflection can be at a sharp angle to the departure direction of the cable clamp, for example. In addition, the clamp parts can be provided with an insulating protective sheath. This serves in particular for electrical insulation. It can also serve to hold the two clamp parts a specific distance apart after their separation. For this purpose, the sheath can be opened in the direction of movement of one clamp part. In addition, it can have latching means for the clamp part that is removed from the other clamp part. As a result of these latching means, the movement of the clamp part is limited and the two clamp parts are prevented from subsequently approaching one another again and restoring contact between them.

The invention will now be described in greater detail with reference to the drawings.

DETAILED DESCRIPTION OF THE DRAWINGS

Figure 1A:
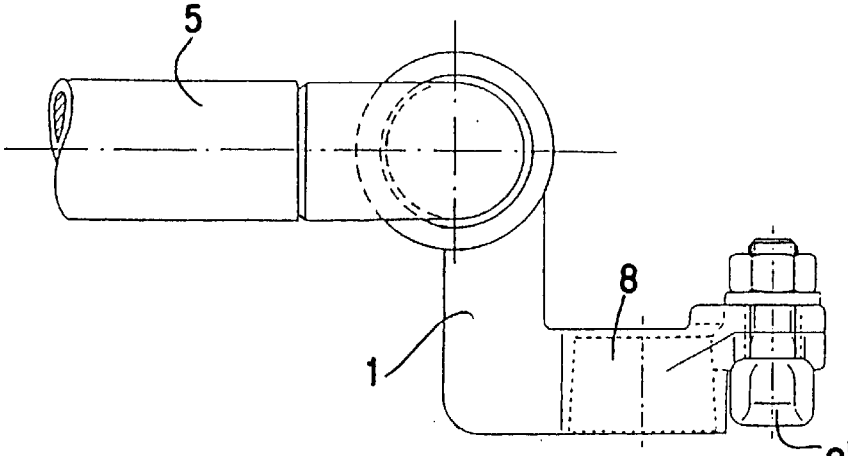
FIG. 1 shows a first design of the invention in a side view (a) and a top view (b)
Figure 1B:
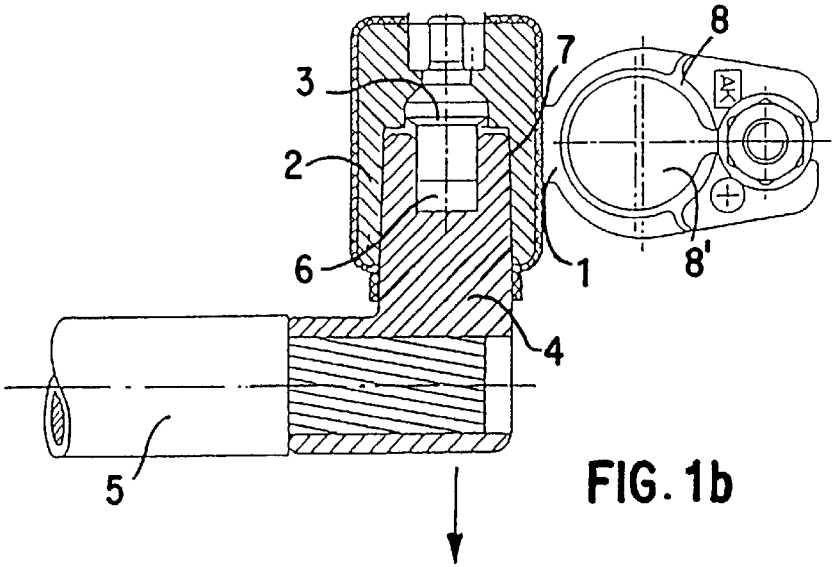

FIG. 1 shows a battery cable clamp (SBK) which (essentially from a known design of a clamp 8) serves for fastening to a battery terminal 8'. SBK 1 also has two clamp parts 2 and 4 that are held by a press fit in their contact area 7 in an electrically conducting connection. In addition, an auxiliary drive in the form of an explosive capsule 3 is provided and is held in clamp part 2. In addition, a preliminary volume 6 is located between explosive capsule 3 and clamp part 4. Finally, clamp part 4 is connected with a battery lead 5.

Figure 2A:
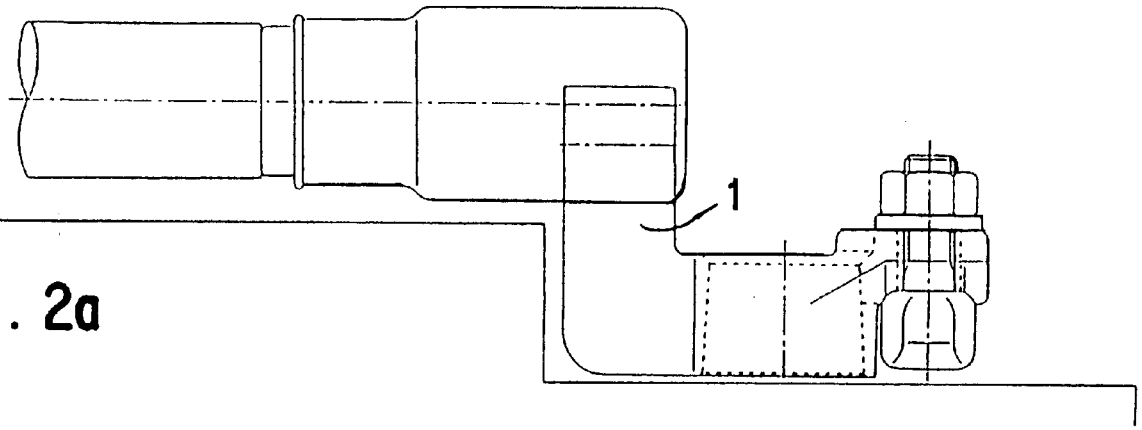
FIG. 2 is an alternative to the embodiment in FIG. 1, likewise in a side view and a top view.
Figure 2B:
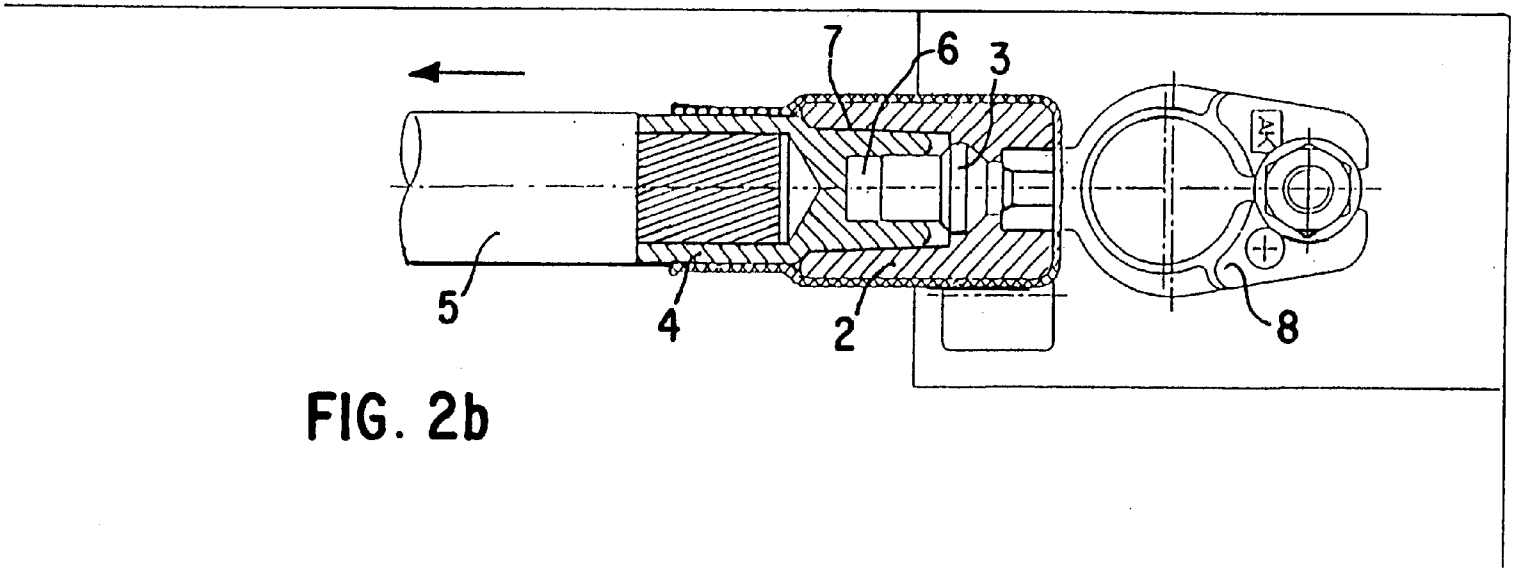
Figure 3:
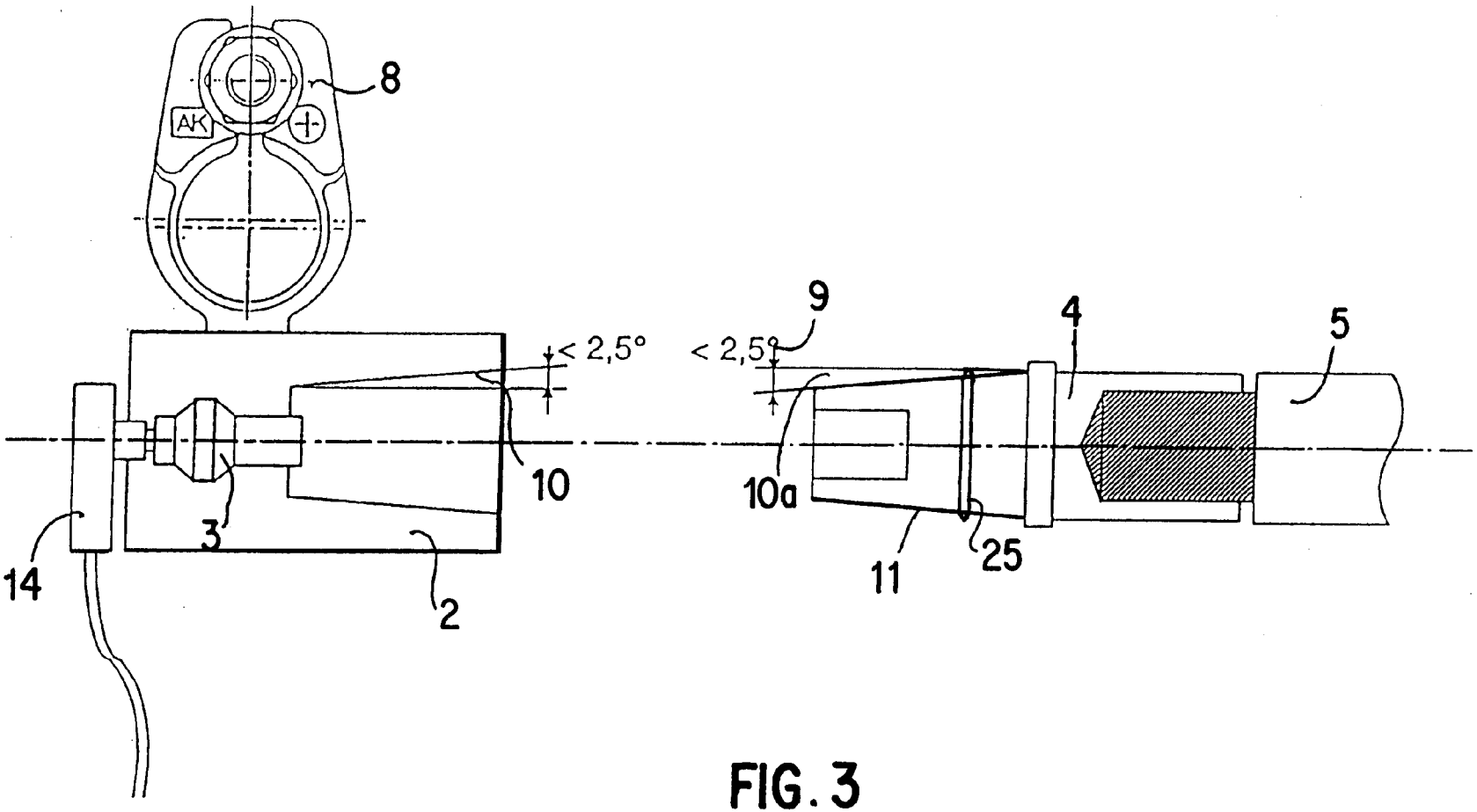
FIG. 3 shows details of the clamp connection according to the invention.

In the embodiment in FIG. 2, the departure direction of battery cable 5 is parallel and flush with the departure direction of battery clamp 8 from battery terminal 8'. In addition, parts with the same functions have been given the same reference numbers as in FIG. 1. The embodiments in FIGS. 1 and 2 have the common feature that when the auxiliary drive becomes operative (via explosive capsule 3), the recoil force that develops during the movement of battery cable 5 in the direction of the arrow is directed past stationary clamp part 2 on battery clamp 8. As a result, there is no damage to battery terminal 8' and hence no damage to the connected vehicle battery.

An important feature of the invention is the conicity of clamp part 4 and the corresponding shaping of the contact surface of clamp part 2 as a conical seat. The conical angles 10*a* of the two contact surfaces that are electrically in contact with one another are approximately the same and have a maximum value of 5°, shown here preferably as approximately 2.5°. This produces a self-locking action during the manufacture of the clamped connection of the two clamp parts 2 and 4. Pressing clamp part 4 into clamp part 2 takes place under controlled force, with a value of 3500 N for example. Manufacturing tolerances are largely compensated in this way. It is important that the manufacturing process itself ensure parallelism between conical angle 10 and cone angle 10*a*. In addition, when pressing in with a controlled force, a clear relationship can be established between the force for pressing in and the force for pressing out (expulsion). The expulsion force, for example, is higher by a factor of 1.1 to 1.3 than the force for pressing in. This expulsion force, which can be calculated, is important for dimensioning the explosive force of explosive capsule 3.

Figure 4:
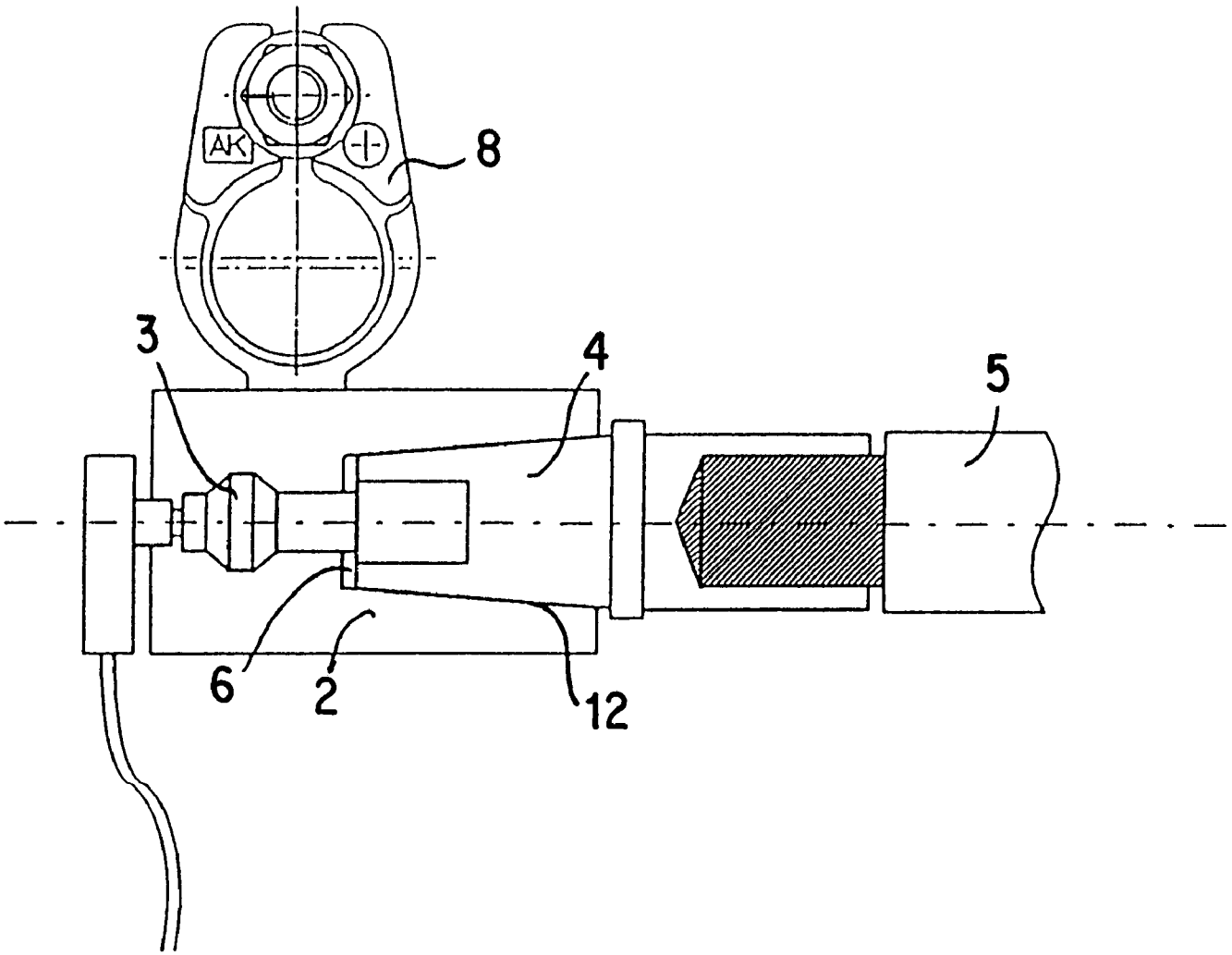
FIG. 4 shows the clamp connection of FIG. 3 in the assembled state.

To avoid contact corrosion, the surface of clamp part 4 and/or the surface of the cone in clamp part 2 is plated with tin, on the surface denoted by reference number 11, for example. In addition to corrosion protection, the tinned surface has the property that during the fitting process the tin flows into any cracks, ribs, depressions, and angular deviations produced by manufacturing, and is cold-welded on the spot. In this way, a correspondingly gastight connection 12 (FIG. 4) can be produced over the entire cone/conical angle joint.

The application of adhesive is also shown which is applied, for example, as an adhesive ring 25 on clamp part 4. Ideally, adhesive materials are used that cure only under pressure (i.e., during and after manufacture of the press fit). By a suitable choice of adhesive material, any retaining forces can be set. The retaining force of the adhesive ring is adjusted so that the total force made up of the retaining force of the press fit and the retaining force of the adhesive spot is still less than the force applied by the explosive capsule 3 when it is triggered.

Figure 5:
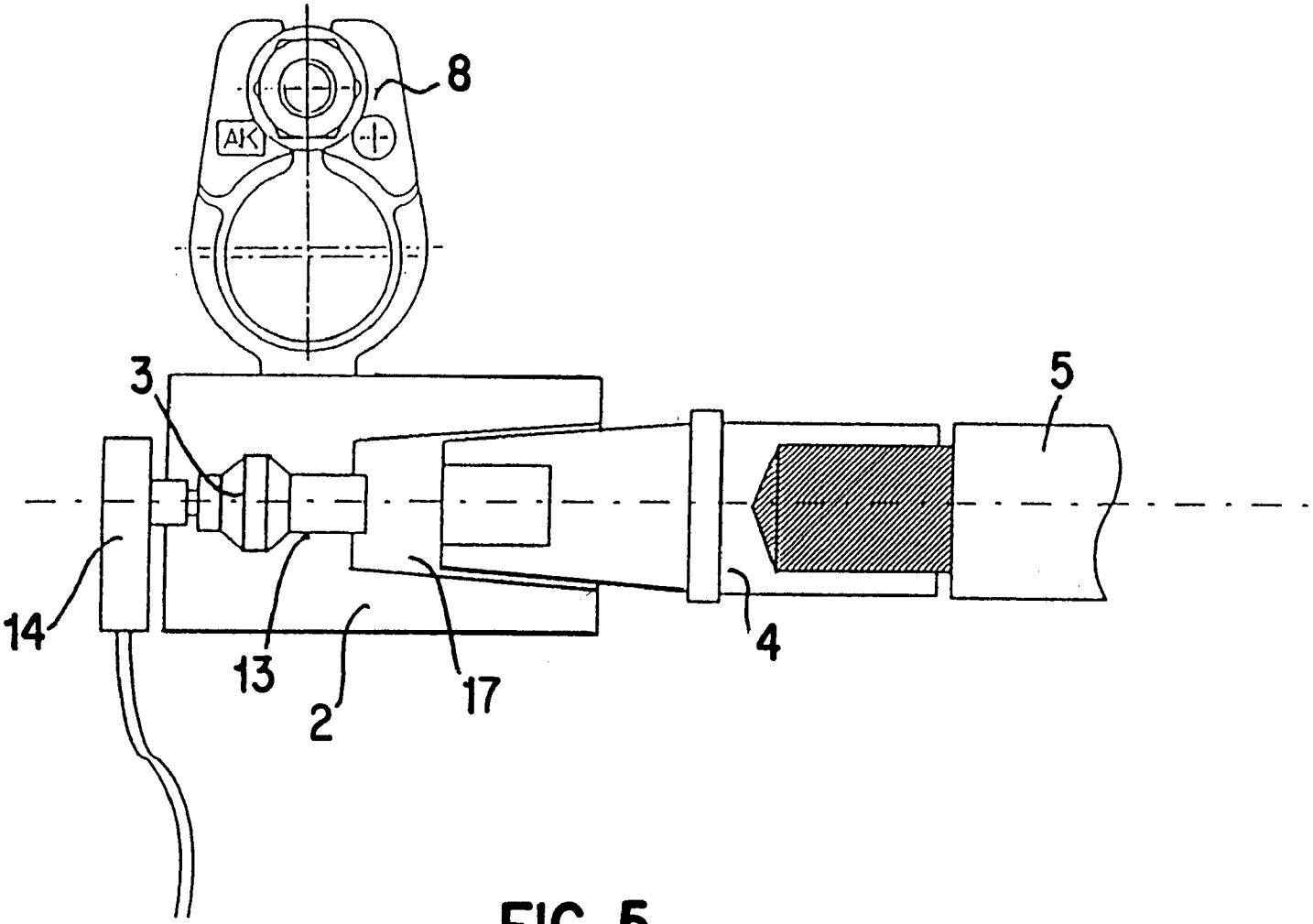
FIG. 5 shows the clamp connection in FIGS. 3 and 4 in the separated state.

In the triggered state, explosive capsule 3 generates a gas that enters preliminary volume 6 and produces an expulsion force on clamp part 4. The latter is forced out of its clamp seat and assumes the position shown in FIG. 5, for example. In this position, the electrical connection between clamp parts 2 and 4 is broken. Due to the conical seat, the expulsion of clamp part 4 takes place with moderate dynamics. This is due to the fact that following the initial loosening of the conical connection, a very large air gap 17 is produced that results in a momentary pressure drop, and as a result battery lead 5 is not accelerated powerfully. In addition, the recoil force on battery terminal 8' is low when triggering takes place. Damage to battery terminal 8' that would have a deleterious effect on function can thus be avoided.

Figure 6:
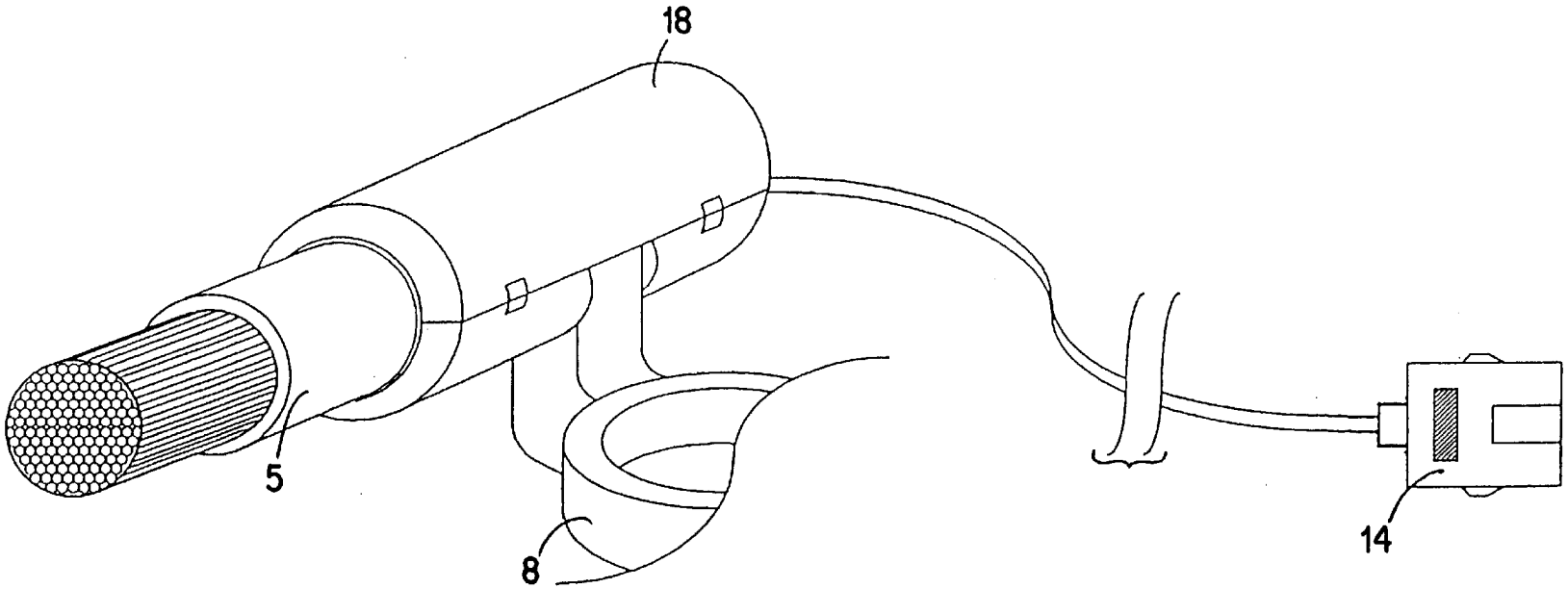
FIG. 6 is a perspective view of another embodiment of the invention.
Figure 7:
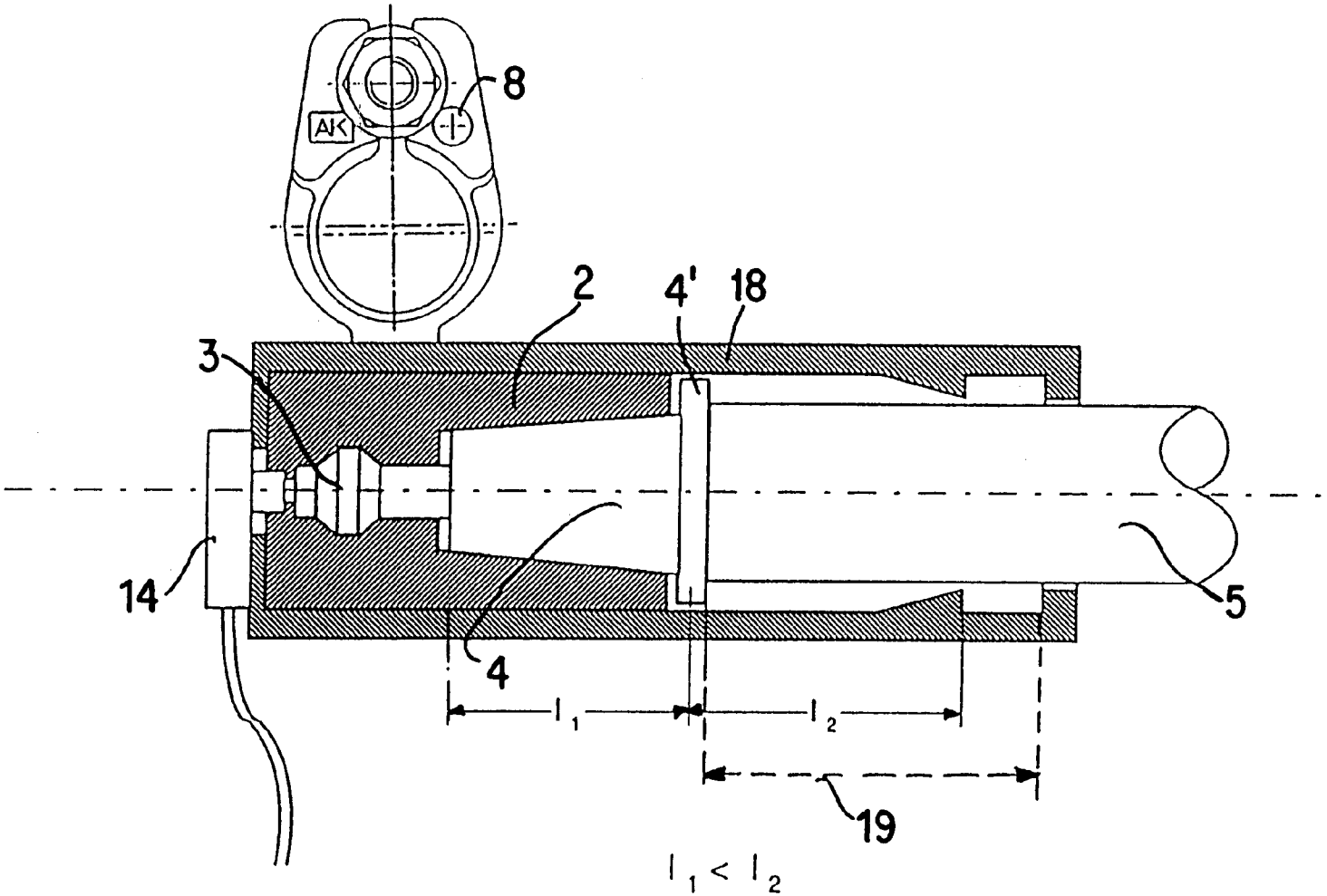
FIG. 7 is a side view of the embodiment in FIG. 6, with the clamp connection closed.

For protecting persons or objects that might be in the vicinity when triggering occurs, clamp part 2 with clamp part 4 pressed in is clipped into a plastic part 18 (FIG. 6) that fulfills two functions:

When clamp part 4 with battery cable 5 is expelled by the auxiliary drive, the travel 19 of clamp part 4 is limited (FIG. 7). At the same time, recoil and hence renewed contact of lead 5 with battery terminal 8' is prevented by latching elements 20. Plastic part 18 also acts as protection against contact.

When explosive capsule 3 is triggered, clamp part 4 moves to the right under the influence of the gas developed in explosive capsule 3 (in FIG. 7) until a collar 4' of clamp part 4 strikes the rear end of plastic part 18. This takes place after distance 19 has been traveled. Ignition of explosive capsule 3 is advantageously performed by an airbag control device 14 (in FIG. 6) or another suitable triggering control (a short-circuit current measurement, for example).

Figure 8:
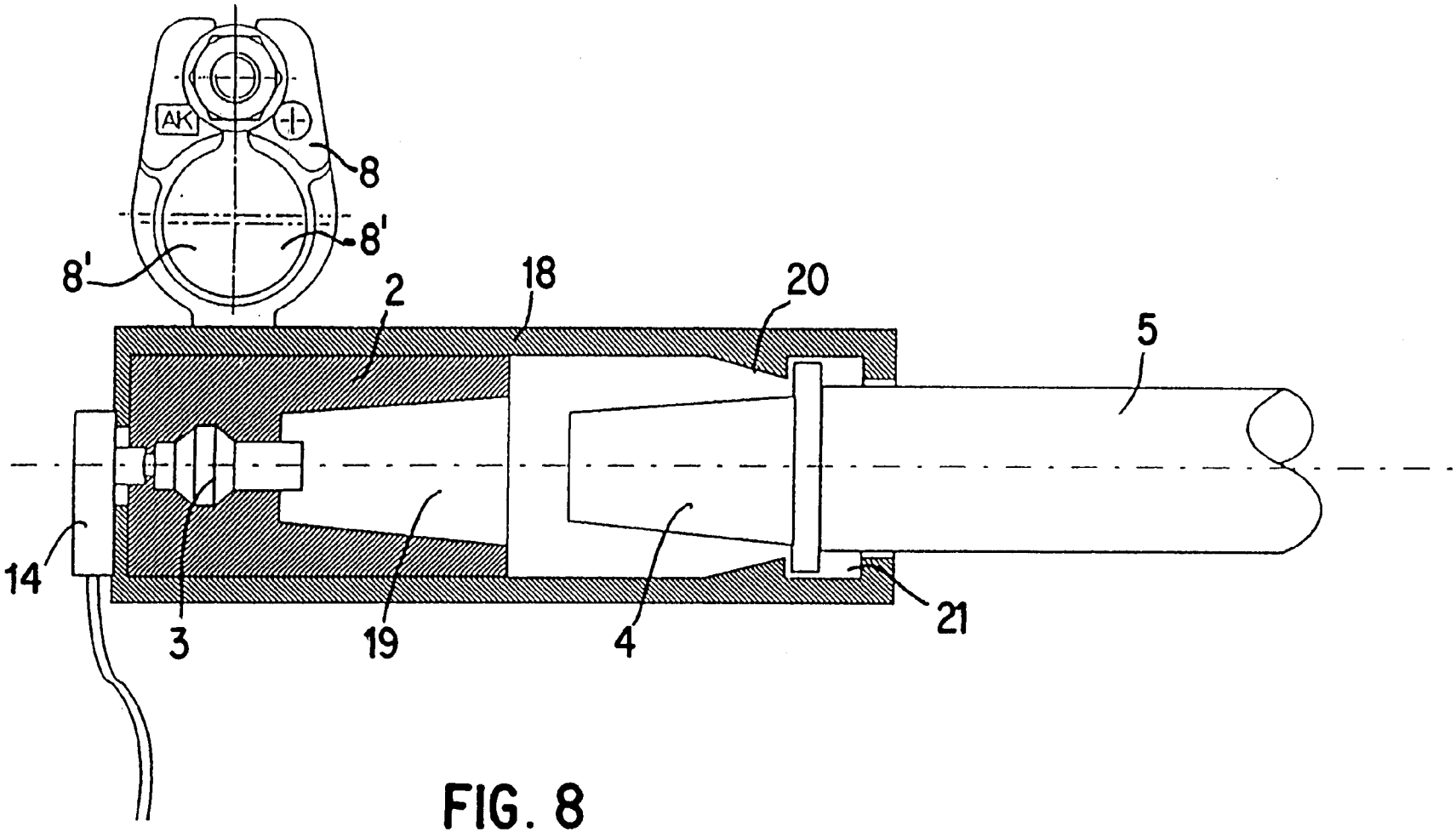
FIG. 8 shows the clamp connection of FIG. 7 in the separated state.

In the position shown in FIG. 8, latching elements 20 are operative and keep clamp part 4 from moving back toward clamp part 2. In this way, the connection between battery cable 5 and battery terminal 8' is permanently broken.

Figure 9:
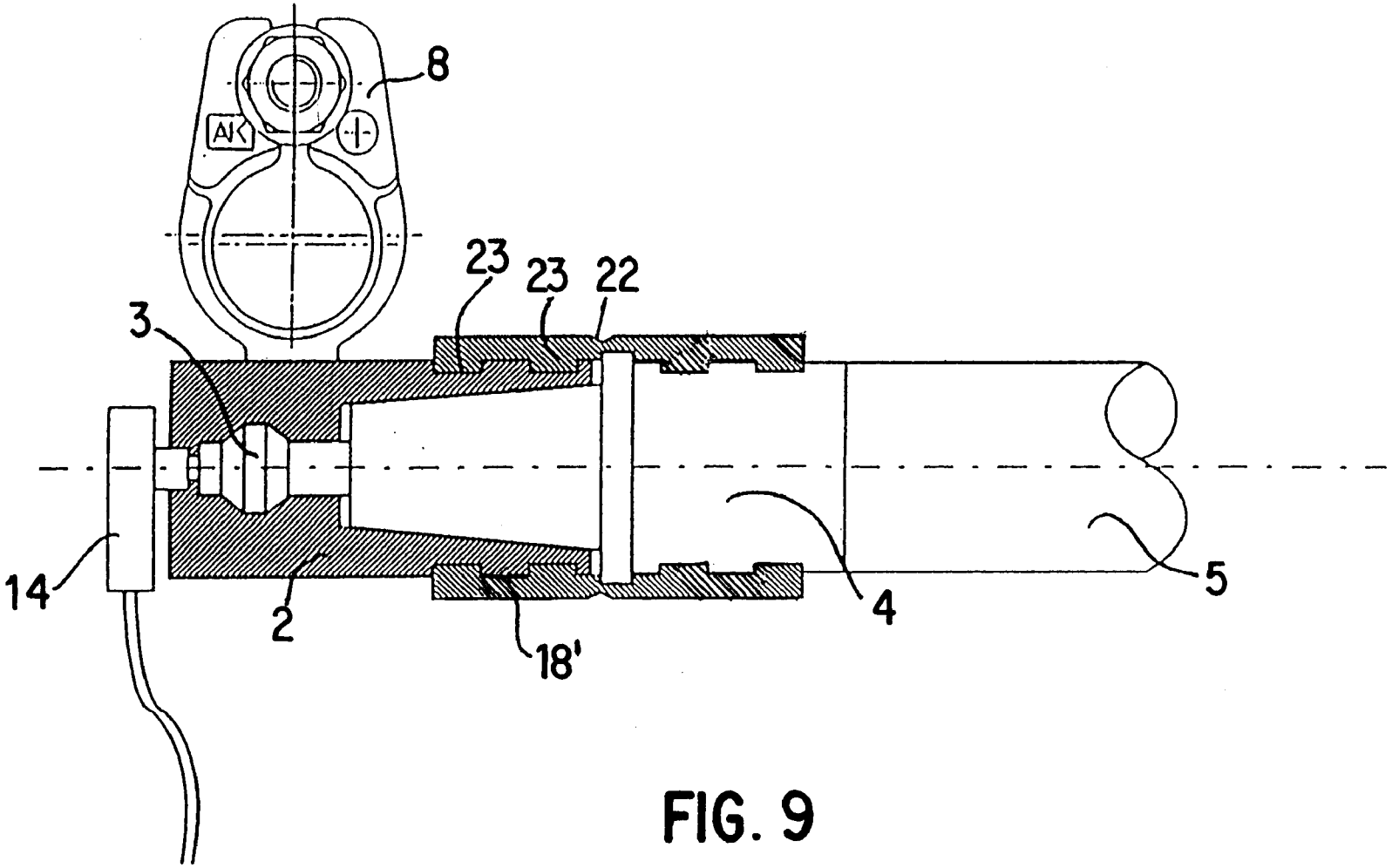
FIG. 9 shows an alternative to the clamp connection in FIG. 7.

Finally, In the embodiment in FIG. 9, plastic part 18' is provided with a predetermined breaking point 22 and latches to clamp part 2 by surrounding annular grooves 23. During the separation process, plastic part 18' separates at predetermined breaking point 22 and the battery cable and clamp part 4 fall off. This prevents accidental reconnection of the press connection between clamp part 4 and clamp part 2.

Installation geometry may require that the separating mechanism (explosive capsule 3 and conical seat 10/11) not be installed directly on battery clamp 8 but as part of the battery lead. This provides universal application possibilities. No changes in the design of the connecting point are needed for incorporation into battery lead 5. Clamp part 2 is not attached to battery clamp 8, however, but is likewise made as a lead connector.

What is claimed is:

1. A battery cable clamp assembly for vehicles, comprising:

a mounting device adaptable to receive a cable end;

a first clamp portion formed in the mounting device;

a second clamp portion disposable in the mounting device in electrical contact with the first clamp portion via a pressed connection, said second clamp portion having a collar and being coupled to the cable end;

an outer protective part for the mounting device having a latch element formed in one-piece therewith;

an auxiliary drive operable to release the pressed connection with a high separation force; and wherein the second clamp portion has a conically shaped contact surface that tapers toward a contact end of the second clamp portion, and the first clamp portion has a substantially correspondingly shaped contact surface that functions as a conical seat in which said second clamp portion is insertable to form the pressed connection, whereby the auxiliary drive produces the high separation force to release the pressed connection and the collar and latch element prevent any reconnection.

2. The battery cable clamp assembly according to claim 1, wherein the contact surfaces have nearly identical cone angles.

3. The battery cable clamp assembly according to claim 1, wherein at least one of the contact surfaces is surface-refined.

4. The battery cable clamp assembly according to claim 1, wherein the first and second clamp portions are glued together in the pressed connection.

5. The battery cable clamp assembly according to claim 1, wherein the outer protective part is an insulating sheath.

* * * * *